US006898153B1

(12) United States Patent
Della Rossa

(10) Patent No.: US 6,898,153 B1
(45) Date of Patent: May 24, 2005

(54) MUSICAL CIRCLE OF FIFTHS CLOCK

(76) Inventor: Victor Della Rossa, 1186 Broadway Suite 1121, New York, NY (US) 10001

( * ) Notice: Subject to any disclaimer, the term of this patent is extended or adjusted under 35 U.S.C. 154(b) by 278 days.

(21) Appl. No.: 10/339,878

(22) Filed: Jan. 10, 2003

(51) Int. Cl.[7] ..... G04C 23/00; G04B 19/00
(52) U.S. Cl. ..... 368/75; 368/272; 368/274
(58) Field of Search ..... 368/72–75, 272–274

(56) References Cited

U.S. PATENT DOCUMENTS 4,073,133 A * 2/1978 Earls et al. ..... 368/273
4,271,495 A 6/1981 Scherzinger et al. ..... 368/75
4,368,989 A * 1/1983 Kawashima ..... 368/74
4,474,480 A * 10/1984 Kato ..... 368/80
4,488,820 A 12/1984 Takebe ..... 368/273
4,575,832 A * 3/1986 Takebe ..... 368/272
5,124,959 A * 6/1992 Yamazaki et al. ..... 368/231
5,949,010 A 9/1999 Hacker ..... 87/476

* cited by examiner

*Primary Examiner*—Vit W. Miska
(74) *Attorney, Agent, or Firm*—Goldstein Law Offices P.C.

(57) ABSTRACT

A musical circle of fifths clock that allows a user to tell practical time as well as hear musical scales at the turn of each hour. The clock has a housing having a face portion and a rear surface. A music generator, positioned within the clock housing, stores the musical scales, and plays the appropriate scale at the turn of each hour. The face portion has an outer perimeter around which hour indicators are positioned. The hour indicators are represented by the tonic of different musical scales. When all of the hour indicators on the face portion are taken as a whole, a perfect circle of fifths is represented.

4 Claims, 3 Drawing Sheets

MUSICAL CIRCLE OF FIFTHS CLOCK

BACKGROUND OF THE INVENTION

The invention relates to a musical circle of fifths clock. In particular, the invention is a clock whose hour intervals are represented by musical scales, wherein each hour is labeled with the scale's corresponding tonic. As each hour is reached, the corresponding musical scale is sounded indicating the time, as well as the musical key.

Music students and musicians often study music theory in order to gain a better understanding of the keys and scales comprising the music. All music is based on a circle of fifths. Each key has a tonic which begins the scale, the tonic being the first note in the scale upon which the harmony is built. The scale is a series of musical notes arranged in sequential ascending or descending order according to pitch.

The circle begins with "middle C". The C major scale contains no flat or sharp notes. Each subsequent tonic is a major fifth apart from the preceding tonic. The name given the scale is also the tonic of the scale. Thus, the first major fifth apart from the beginning point is "G", the second is "D", the third is "A", the fourth is "E", the fifth is "B", and the sixth is "F sharp". Each scale subsequent to the beginning point contains one sharp note more than the preceding scale (i.e. "G major" has one sharp, "D" has two sharps, "A" has three sharps, "E" has four sharps, "B" has five sharps, and "F sharp" has six sharps). Likewise, each scale preceding "middle C" contains one more flat note (i.e. "F major" has one flat, "B flat" has two flats, "E flat" has three flats, "A flat" has four flats, "D flat" has five flats). When taken together, this arrangement of scales includes all of the musical keys.

The clock described herein provides a musical schematic of the circle of fifths while also providing the time of day. Thus, the musical circle of fifths clock coordinates music theory and ear training with practical time.

While the units available may be suitable for the particular purpose employed, or for general use, they would not be as suitable for the purposes of the present invention as disclosed hereafter.

SUMMARY OF THE INVENTION

In view of the foregoing disadvantages inherent in the prior art, the present invention provides an improved clock that incorporates musical theory and ear training into the telling of practical time. As such, the general purpose of the present invention, which will be described subsequently in greater detail, is to provide a new and improved musical circle of fifths clock which has all the advantages of the prior art and none of the disadvantages.

To attain this, the present invention essentially comprises a musical circle of fifths clock that allows a user to tell practical time as well as hear musical scales at the turn of each hour. The clock has a housing having a face portion and a rear surface. A music generator, positioned within the clock housing, stores the musical scales, and plays the appropriate scale at the turn of each hour. The face portion has an outer perimeter around which hour indicators are positioned. The hour indicators are represented by the tonic of different musical scales. When all of the hour indicators on the face portion are taken as a whole, a perfect circle of fifths is represented.

It is an object of the invention to produce a musical circle of fifths clock that couples musical theory with practical time. Accordingly, the hour indicators on the clock face are the tonics of each musical scale. Thus, a user is able to tell the time of day from the clock, as well as gain a better understanding of the circle of fifths.

It is a further object of the invention to produce a musical circle of fifths clock that plays different musical scales at the turn of each hour. Accordingly, the clock has a music generator and a position sensor, wherein at each hour a musical scale is emitted. The musical scale played corresponds to the hour indicator tonic on the clock face. A user is then able to relate the pitch of a key with the appropriate tonic, and the corresponding time of day.

To the accomplishment of the above and related objects the invention may be embodied in the form illustrated in the accompanying drawings. Attention is called to the fact, however, that the drawings are illustrative only. Variations are contemplated as being part of the invention, limited only by the scope of the claims.

BRIEF DESCRIPTION OF THE DRAWINGS

In the drawings, like elements are depicted by like reference numerals. The drawings are briefly described as follows.

REFERENCE NUMERALS

Figure 1:
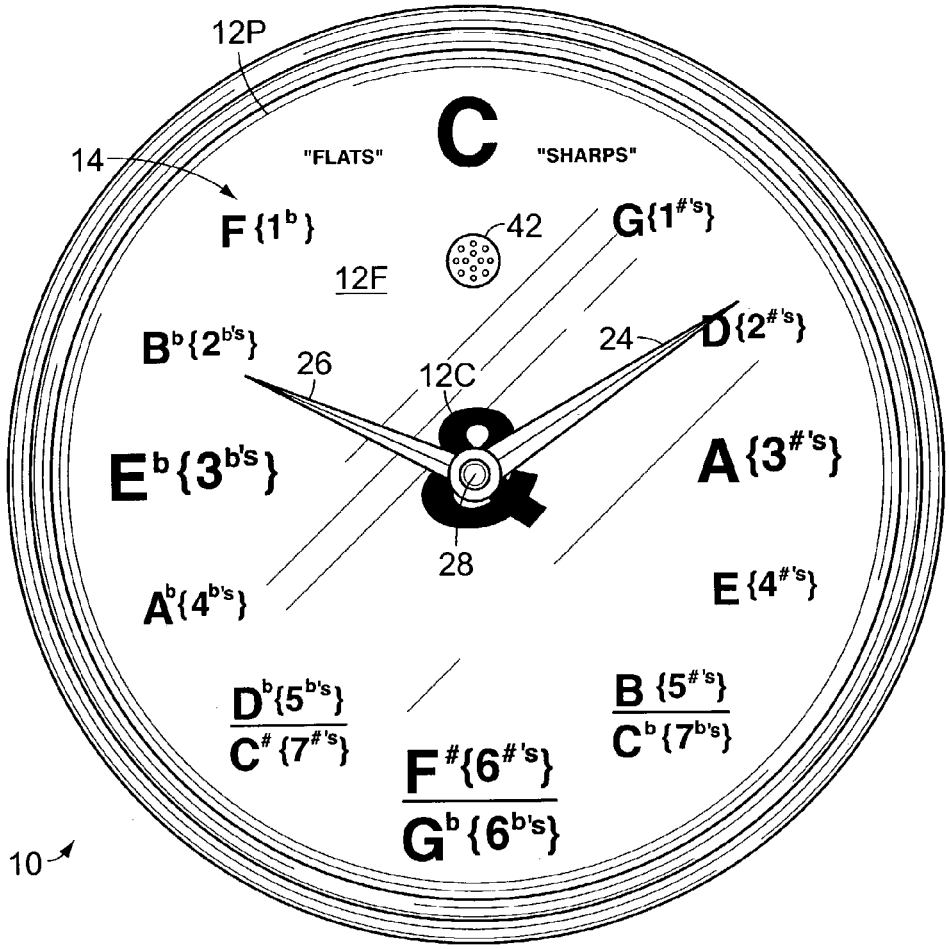
FIG. 1 is a front elevational view of the musical circle of fifths clock.
Figure 2:
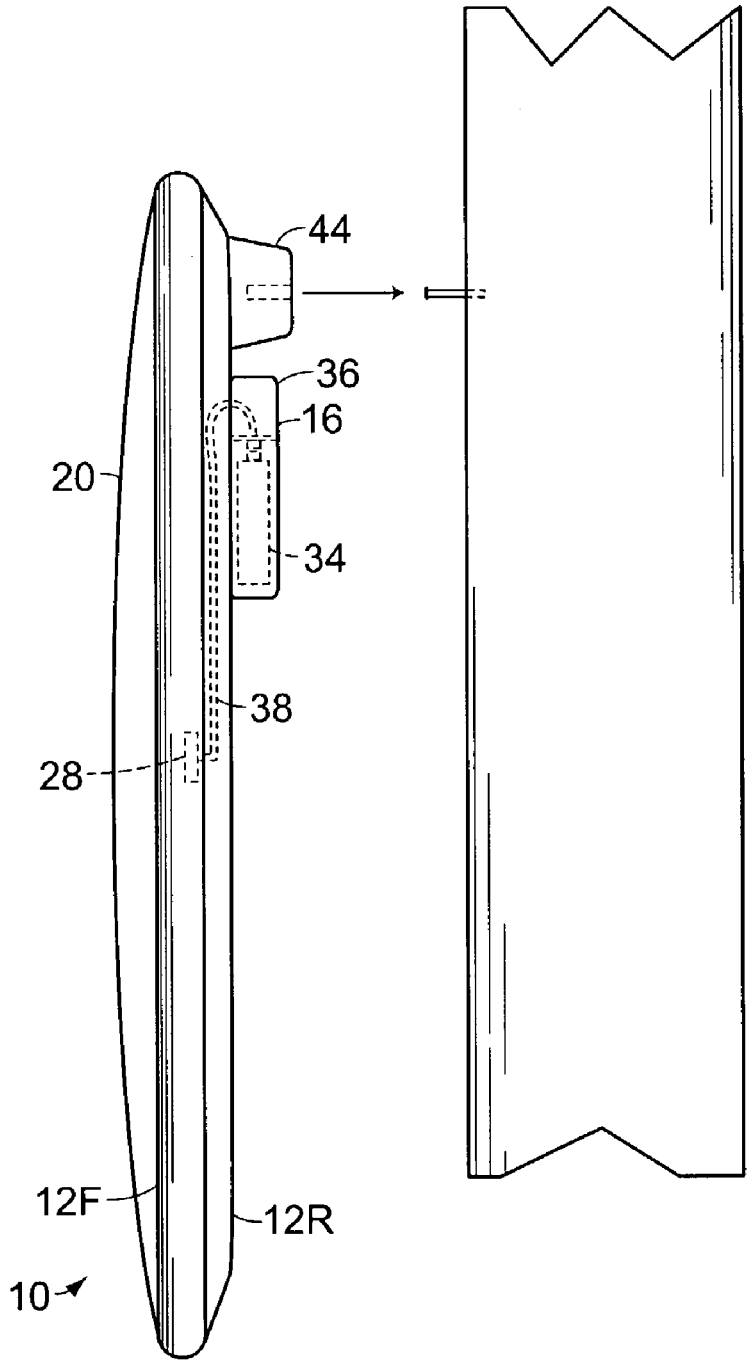
FIG. 2 is a side elevational view of the clock, illustrating the mounting of the clock on a vertical surface.

10 musical circle of fifths clock
12 housing
12F face portion
12P face portion outer perimeter
12R housing rear surface
12C face portion center point
14 hour indicator
16 battery compartment
18 speaker
20 dome cover
24 long hand
26 short hand
28 center axis
30 position sensor
32 motor
34 battery
36 access plate
38 wire
40 music generator
42 speaker
44 mounting plate.

DETAILED DESCRIPTION OF THE PREFERRED EMBODIMENTS

FIG. 1 illustrates a musical circle of fifths clock 10 that allows a user to tell practical time as well as hear musical scales at the turn of each hour. The clock 10 essentially comprises a housing 12 having a face portion 12F, a battery compartment 16 that provides power to the clock 10, and a speaker 18 through which audible sounds are emitted. A music generator 40 is also provided within the housing 12 of the clock 10. The music generator 40 stores and is capable of generating twelve major musical scales, and plays the appropriate scale at the turn of each hour. The face portion 12F has an outer perimeter 12P around which hour indicators 14 are positioned. The clock 10 may be in the form of any shape, however for illustrative purposes only, the clock 10 is shown as a circle in the drawing figures.

Figure 3:
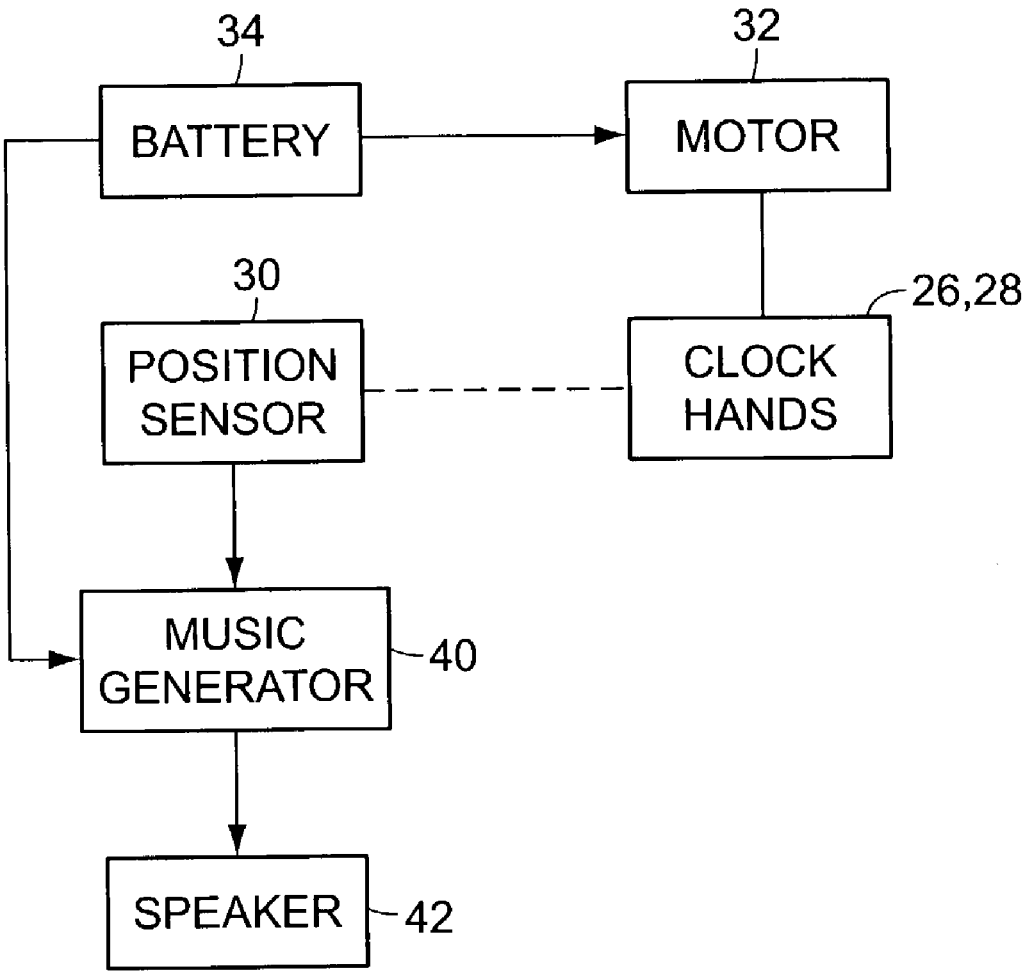
FIG. 3 is a block diagram illustrating the working of the clock.

The housing 12 has a rear surface 12R opposite the face portion 12F. The face portion 12F may be covered with a transparent glass dome cover 20 in order to protect the face portion 12F from damage. The face portion 12F also has a center point 12C from which time indicating means originate. As with most standard clocks, the time indicating means comprises a long hand 24 and a short hand 26, wherein the short hand 26 indicates the hour and the long hand 24 indicates the minutes. The hands 24, 26 are secured to a center axis 28 that extends through the face portion center point 12C. The hands 24, 26 rotate about the center axis 28 in order to consistently indicate the time. The center axis 28 and the hands 24, 26 are in communication with the motor 32. As illustrated in FIG. 3, the hands 24, 26 are also in communication with a position sensor 30. The position sensor 30 serves to maintain the correct time, thereby prompting the movement of the arms 24, 26 at appropriate intervals.

The hour indicators 14 are represented by different musical scales. When all of the hour indicators 14 on the face portion 12F are taken as a whole, a perfect circle of fifths is represented. Each scale is represented by its tonic, along with the corresponding number of sharps or flats included in that scale. In particular, the first hour indicator is "G{1#'s}, the second hour indicator is "D{2#'s}, the third hour indicator is A{3#'s}, the fourth hour indicator is "E{4#'s}, the fifth hour indicator is "B{5#'s}/Cb{7b's}, the sixth hour indicator is "F#{6#'s}/Gb{6b's}, the seventh hour indicator is "Db{5b's}/C#{7#'s}, the eighth hour indicator is "Ab{4b's}, the ninth hour indicator is "Eb{3b's}, the tenth hour indicator is "Bb{2b's}, the eleventh hour indicator is "F{1b's}, and the twelfth hour indicator is "C". Each hour indicator is a major fifth apart. More particularly, in the clockwise direction, at each successive position, the tonic is a major fifth higher, thereby adding one sharp. Conversely, in the counterclockwise direction, each "lower" indicator is a major fifth lower, thereby adding one flat.

The battery compartment 16 holds batteries and is positioned within the housing 12. The compartment 16 has an access plate 36 along the housing rear surface 12R for accessing the batteries 34. A wire 38 extends between the batteries 34 and the center axis 28. The battery supplies electricity to the motor 32 and the music generator 40. Further, the motor 32 is in communication with the center axis 28 in order to cause the hands 26, 28 to rotate about the face portion 12F.

A speaker 40 is positioned on the face portion 12F, said speaker 40 emitting audible tones generated by the music generator 40.

As illustrated in FIG. 3, the housing rear surface 12R may also have a mounting plate 44 positioned near the edge of the clock 10. This plate 44 allows the clock 10 to be hung on a vertical surface, such as a wall or a door.

In conclusion, herein is presented a musical circle of fifths clock that allows a user to determine the time of day, as well as learn the musical scales. The invention is illustrated by example in the drawing figures, and throughout the written description. It should be understood that numerous variations are possible, while adhering to the inventive concept. Such variations are contemplated as being a part of the present invention.

What is claimed is:

1. A musical circle of fifths clock for telling time and teaching musical scales, comprising:

a housing, the housing having a face portion and a rear surface, the face portion having an outer perimeter, a center point having a center axis from which a long hand and a short hand originate and extend outward toward the outer perimeter;

a plurality of hour indicators, the hour indicators being positioned on the housing face portion around the outer perimeter, wherein each hour indicator is a tonic of a musical scale;

a position sensor, the position sensor being in communication with the time indicating means whereby the position sensor serves to determine the position of the long hand and short hand; and a music generator, the music generator storing the musical scales and playing the appropriate scale according to the hour indicator as determined by the position sensor; and at least one battery, the at least one battery housed in a battery compartment and in communication with the music generator;

a motor, the motor being in communication with the battery, for moving the long hand and short hand about the central axis in a twelve hour cycle; and a speaker, the speaker positioned on the housing face portion, said speaker emitting audible tones generated by the music generator.

2. The musical circle of fifths clock as recited in claim 1, wherein the hour indicators are coupled with the corresponding number of sharps and flats in the corresponding musical scale.

3. The musical circle of fifths clock as recited in claim 2, wherein the housing face portion is covered with a transparent dome cover, said cover protecting the face portion from damage.

4. The musical circle of fifths clock as recited in claim 3, further comprising a mounting plate, the mounting plate positioned on the housing rear surface for allowing the clock to be hung on a vertical surface.

* * * * *